US011586127B2

(12) United States Patent
Goto et al.

(10) Patent No.: US 11,586,127 B2
(45) Date of Patent: Feb. 21, 2023

(54) IMAGE FORMING APPARATUS AND CARTRIDGE HAVING SHUTTERS TO OPEN AND CLOSE A DEVELOPER SUPPLYING AND RECEIVING PORTS

(71) Applicant: CANON KABUSHIKI KAISHA, Tokyo (JP)

(72) Inventors: Joji Goto, Tokyo (JP); Tsukasa Abe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/520,846

(22) Filed: Nov. 8, 2021

(65) Prior Publication Data

US 2022/0057730 A1 Feb. 24, 2022

Related U.S. Application Data

(63) Continuation of application No. 17/022,246, filed on Sep. 16, 2020, now Pat. No. 11,194,268.

(30) Foreign Application Priority Data

Sep. 17, 2019 (JP) ..... JP2019-168874

(51) Int. Cl.
*G03G 15/08* (2006.01)

(52) U.S. Cl.
CPC ..... *G03G 15/0886* (2013.01); *G03G 15/0875* (2013.01); *G03G 15/0808* (2013.01); *G03G 2215/068* (2013.01); *G03G 2215/0692* (2013.01)

(58) Field of Classification Search
CPC ..... G03G 15/0886; G03G 15/0875; G03G 2215/068; G03G 2215/0692
USPC ..... 399/258, 262
See application file for complete search history.

(56) References Cited

U.S. PATENT DOCUMENTS

| | | | |
|---|---|---|---|
| 6,597,882 | B1 | 7/2003 | Tanaka |
| 8,526,861 | B2 | 9/2013 | Matsumoto |
| 9,195,210 | B2 | 11/2015 | Tanaka |
| 9,459,557 | B1 | 10/2016 | Kasukawa |
| 10,802,421 | B2 | 10/2020 | Tojo |
| 2007/0059045 | A1 | 3/2007 | Kubota et al. |

(Continued)

FOREIGN PATENT DOCUMENTS

| | | | |
|---|---|---|---|
| EP | 1 845 422 | A2 | 10/2007 |
| JP | 2000-029309 | A | 1/2000 |

(Continued)

OTHER PUBLICATIONS

Feb. 2, 2021 Extended Search Report in European Patent Application No. 20 196 375.8.

*Primary Examiner* — Robert B Beatty
(74) *Attorney, Agent, or Firm* — Venable LLP

(57) ABSTRACT

A first contact portion provided on a first shutter member that opens and closes a receiving port for receiving a developer from a cartridge and a second contact portion provided on the cartridge are configured to contact each other in an attachment and detachment direction of the cartridge so that the first shutter member is in a position at which the receiving port is opened. The first shutter member is urged by a first urging member so that a contacting state between the first contact portion and the second contact portion is maintained until a second shutter member that opens and closes a supplying port of the cartridge closes the supplying port when the cartridge is discharged from the apparatus body.

14 Claims, 10 Drawing Sheets

(56) References Cited

U.S. PATENT DOCUMENTS

| | | | |
|---|---|---|---|
| 2007/0237551 | A1 | 10/2007 | Kawai |
| 2008/0063427 | A1 | 3/2008 | Ikado et al. |
| 2008/0181673 | A1 | 7/2008 | Kim et al. |
| 2013/0028617 | A1 | 1/2013 | Fukuoka et al. |
| 2014/0348547 | A1 | 11/2014 | Tanaka |
| 2017/0248905 | A1 | 8/2017 | Anan et al. |
| 2018/0329359 | A1 | 11/2018 | Anan et al. |
| 2021/0141332 | A1 | 5/2021 | Anan et al. |
| 2021/0080868 | A1 | 7/2021 | Yamada et al. |

FOREIGN PATENT DOCUMENTS

| | | | |
|---|---|---|---|
| JP | 2012-083399 | A | 4/2012 |
| JP | 2013-029676 | A | 2/2013 |
| JP | 2014-202847 | A | 10/2014 |

IMAGE FORMING APPARATUS AND CARTRIDGE HAVING SHUTTERS TO OPEN AND CLOSE A DEVELOPER SUPPLYING AND RECEIVING PORTS

BACKGROUND OF THE INVENTION

Field of the Invention

The present invention relates to an image forming apparatus including an automatic discharging mechanism for a toner cartridge attachable to and detachable from an apparatus body.

Description of the Related Art

Image forming apparatuses such as copiers and printers are often used by various users in daily activities. Accordingly, the image forming apparatuses preferably have a structure that allows even users unaccustomed to operating the apparatuses to easily perform maintenance such as the replacement of cartridges. In view of this, there has been known a configuration in which cartridges are locked until a replacement period and a cartridge to be replaced is automatically discharged to the outside of an apparatus body at the replacement period.

For example, Japanese Patent Application Laid-open No. 2014-202847 discloses, as a mechanism for discharging a cartridge, a configuration in which a supporting board beneath a cartridge includes gears and the gears are driven to discharge the cartridge to the outside of an apparatus. Further, Japanese Patent No. 5307200 discloses a configuration in which an apparatus body includes a pressing part, a pressing-part rotating and supporting pin, a solenoid, and a tensile spring on the rear side of a toner cartridge and operates the solenoid to turn the pressing part and move the toner cartridge to an extracting position.

SUMMARY OF THE INVENTION

However, in the configuration described in Japanese Patent Application Laid-open No. 2014-202847, the installation of gears or a driving configuration for discharging a cartridge is required, which results in the upsize of the apparatus or an increase in the number of parts. Further, in the configuration described in Japanese Patent No. 5307200, the movement amount or pressing force of a cartridge is limited according to the performance of the solenoid. Particularly, in a cartridge having a toner delivering port for delivering toner to an apparatus body and a shutter member that opens and closes the port, the toner delivering port is preferably closed by the shutter member at an extracting position to prevent the leakage or scattering of the toner. However, in a discharging configuration using a solenoid, the degree of freedom in design is limited due to the constraint of a movement amount.

The present invention has an object of providing an image forming apparatus capable of automatically discharging a cartridge with a simple configuration and preventing the leakage or scattering of toner at an extracting position without causing the upsize of the apparatus or an increase in the number of parts.

In order to achieve the above object, an image forming apparatus according to the present invention comprising:

an apparatus body including an image forming portion that forms an image on a recording material using a developer; and a cartridge configured to be attachable to and detachable from the apparatus body and accommodates the developer in an attachment and detachment direction, wherein the apparatus body includes a developer receiving part having a receiving port for receiving the developer from the cartridge, a first shutter member movable between a first open position in which the receiving port is opened and a first closed position in which the receiving port is closed in the attachment and detachment direction, and a first urging member that urges the first shutter member in a direction from the first opened position to the first closed position, wherein the cartridge includes a supplying port through which the developer is supplied to the apparatus body, a second shutter member movable between a second open position in which the supplying port is opened and a second closed position in which the supplying port is closed, and a second urging member that urges the second shutter member in a direction from the second open position to the second closed position, wherein the first shutter member has a first contact portion, and the cartridge has a second contact portion, the first contact portion and the second contact portion are configured to contact each other so that the first shutter member is in the first open position against an urging force of the first urging member when the cartridge is attached to the apparatus body, wherein the apparatus body has a third contact portion, and the second shutter member has a fourth contact portion, the third contact portion and the fourth contact portion are configured to contact each other so that the second shutter member is in the second open position against an urging force of the second urging member when the cartridge is attached to the apparatus body, and wherein the first shutter member is urged by the first urging member so that a contacting state between the first contact portion and the second contact portion is maintained until the second shutter member is moved to the second closed position while the cartridge is being discharged from the apparatus body.

According to the present invention, it is possible to reliably close the opening of a cartridge at the discharging position of the cartridge and prevent the leakage or scattering of toner when the cartridge is discharged.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

In the following description, a "front side" or a "front" in an image forming apparatus or the like corresponds to the front side (the near side in a case in which a user faces the image forming apparatus in normal use) of the image forming apparatus in a normal installation state in which the image forming apparatus is placed on a horizontal installation surface. Further, a "rear side" or a "rear" in the image forming apparatus or the like is a side opposite to the "front side" or the "front" and corresponds to the rear side (the back side in a case in which the user faces the image forming apparatus in the normal use) of the image forming apparatus in the normal installation state. Further, a "front-rear direction" corresponds to a direction from the "front side" to the "rear side" or its opposite direction and is also a horizontal direction parallel to the installation surface. Further, a "top and bottom," an "upper side," a "lower side," an "upward turn," a "downward turn," an "upper direction," a "lower direction," and the like are expressions based on a "top" and a "bottom" when seen from the user facing the front side of the image forming apparatus with a direction perpendicular to the installation surface of the image forming apparatus as a reference. Further, a "right and left," a "left side," a "right side," a "left direction," a "right direction," and the like are expressions based on a "left" and a "right" when seen from the user facing the front side of the image forming apparatus with a horizontal direction orthogonal to the depth direction of the image forming apparatus in the normal installation state as a reference.

Figure 1:
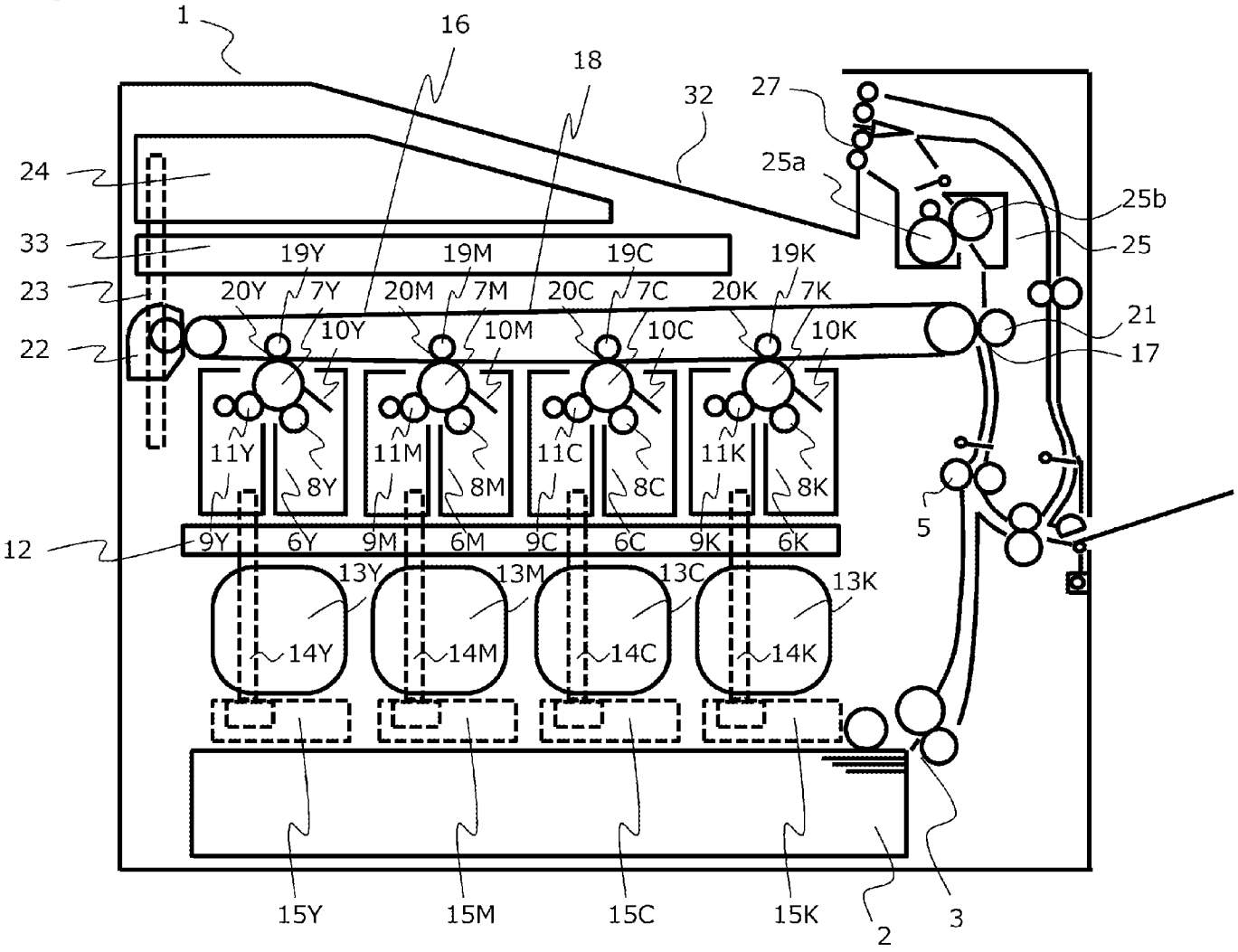
FIG. 1 is a main cross-sectional view of an image forming apparatus 1 according to a first embodiment of the present invention.

FIG. 1 is a schematic main cross-sectional view showing the entire configuration of an image forming apparatus 1 according to a first embodiment of the present invention and is also a cross-sectional view of the image forming apparatus 1 when seen from its front side.

Paper Feed

At the lower part of the image forming apparatus 1, a cassette 2 is accommodated so as to be drawable. A cassette feeding part 3 is disposed near the end of the cassette 2. Transfer materials are accommodated in the cassette 2 in a stacked state, separated one by one, and fed to a resist roller 5.

Image Forming Portion

The image forming apparatus 1 includes an image forming portion 6 that serves as image forming means in which image forming stations 6Y, 6M, 6C, and 6K that correspond to the toner (developer) of the respective colors of yellow, magenta, cyan, and black are arranged in a line. In the image forming portion 6, photosensitive drums 7Y, 7M, 7C, and 7K (hereinafter collectively called photosensitive drums 7) that serve as image bearing members, charging apparatuses 8Y, 8M, 8C, and 8K (charging apparatuses 8) that uniformly charge the surfaces of the photosensitive drums 7, developing apparatuses 9Y, 9M, 9C, and 9K (developing apparatuses 9) that attach the toner to electrostatic latent images to be developed as toner images (developed images), and cleaning blades 10Y, 10M, 10C, and 10K (cleaning blades 10) that remove residual toner remaining on the photosensitive drums 7 are internally provided. Further, in the developing apparatuses 9, developing rollers 11Y, 11M, 11C, and 11K (developer rollers 11) that correspond to the respective colors are configured to be capable of contacting and separating from the respective photosensitive drums 7. Each of the developing rollers 11 performs contact and separation according to an electrostatic latent image, that is, according to a need to perform development. In this manner, the developing rollers 11 increase their service lives. Under the image forming portion 6, a scanner unit 12 that irradiates the photosensitive drums 7 with a laser beam on the basis of image information to form electrostatic latent images on the photosensitive drums 7 is provided. The image forming stations 6Y, 6M, 6C, and 6K are configured to be attachable to and detachable from the apparatus body of the image forming apparatus 1 as process cartridges. The process cartridges are configured so that the developing apparatuses 9 including the developing rollers 11 and photosensitive units including the photosensitive drums 7, the charging apparatuses 8, and the cleaning blades 10 are separately or integrally attachable to and detachable from the apparatus body. Here, the apparatus body of the image forming apparatus 1 indicates a constituting part other than configurations attachable to and detachable from the image forming apparatus 1 such as the process cartridges described above and toner cartridges that will be described below.

Toner Cartridge (Developer Cartridge)

Between the scanner unit 12 and the cassette 2, toner cartridges 13Y, 13M, 13C, and 13K (toner cartridges 13) that serve as replenishing cartridges to replenish the respective image forming stations (image forming portion) 6 with the toner are substantially horizontally disposed. Inside the toner cartridges 13, replenishing toner corresponding to the respective colors is filled. Toner transporting apparatuses 14Y, 14M, 14C, and 14K (toner transporting apparatuses 14) upwardly transport the toner received from the toner cartridges 13 and supply the toner to the developing apparatuses 9. The toner transporting apparatuses 14 are driven by toner transporting driving apparatuses 15Y, 15M, 15C, and 15K (toner transporting driving apparatuses 15) disposed under the toner transporting apparatuses 14. The details of the toner cartridges 13 and the toner transporting apparatuses 14 will be described later.

Transfer

Over the developing apparatuses 9, an intermediate transfer unit 16 is provided. The intermediate transfer unit 16 is arranged substantially horizontally with its side facing the respective image forming stations (image forming portion) 6 directed downward. The intermediate transfer belt 18 facing the respective photosensitive drums 7 is a rotatable endless belt and stretched by a plurality of stretching rollers. On the inner surface of the intermediate transfer belt 18, primary transfer rollers 19Y, 19M, 19C, and 19K (primary transfer rollers 19) are arranged as primary transfer materials. The respective primary transfer rollers 19 are arranged at positions at which the primary transfer rollers 19 form primary transfer parts 20Y, 20M, 20C, and 20K (primary transfer parts 20) with the respective photosensitive drums 7 via the intermediate transfer belt 18. At the respective primary transfer parts 20, toner images are transferred from the respective photosensitive drums 7 onto the intermediate transfer belt 18 by the primary transfer rollers 19 to which a voltage is applied. In the present embodiment, a unit including the intermediate transfer belt 18, the plurality of stretching rollers stretching the intermediate transfer belt 18, and the respective primary transfer rollers 19 is configured to be attachable to and detachable from the apparatus body as an intermediate transfer unit 16.

A secondary transfer roller 21 that serves as a secondary transfer material contacts the intermediate transfer belt 18 and forms a secondary transfer part 17 with a roller on an opposite side via the intermediate transfer belt 18. At the secondary transfer part 17, a toner image that has been transferred onto the intermediate transfer belt 18 is secondarily transferred onto a transfer material (recording material) such as a paper. Toner that has not been transferred onto the transfer material in the secondary transfer and has remained on the intermediate transfer belt 18 is removed by a cleaning unit 22. The toner that has been removed by the cleaning unit 22 is transported to and accumulated in a toner collecting container 24 via a toner transporting part 23.

Fixation and Discharging of Paper

A transfer material onto which a toner image has been transferred at the secondary transfer part 17 is then transported to a fixation apparatus 25 and passes through a nip formed by a heating unit 25*a* arranged inside the fixation apparatus 25 and a pressure roller 25*b* that comes into press-contact with the heating unit 25*a*. The transfer material on which the toner image has been fixed after passing through the fixation apparatus 25 is transported to a pair of discharging rollers 27 and discharged to a transfer-material stacking part 32.

Power Supply Apparatus

On the rear side of the image forming apparatus 1, a low-voltage power supply apparatus (not shown) that supplies a voltage to a control unit for controlling various motors, a fan, a solenoid, or the like provided inside the image forming apparatus 1 is arranged. Further, in the space between the intermediate transfer belt 18 and the toner collecting container 24, a high-voltage power supply apparatus 33 that supplies a high voltage to the charging apparatuses 8, the developing apparatuses 9, the primary transfer rollers 19, the secondary transfer roller 21, or the like is arranged.

Developing Apparatus

Figure 2:
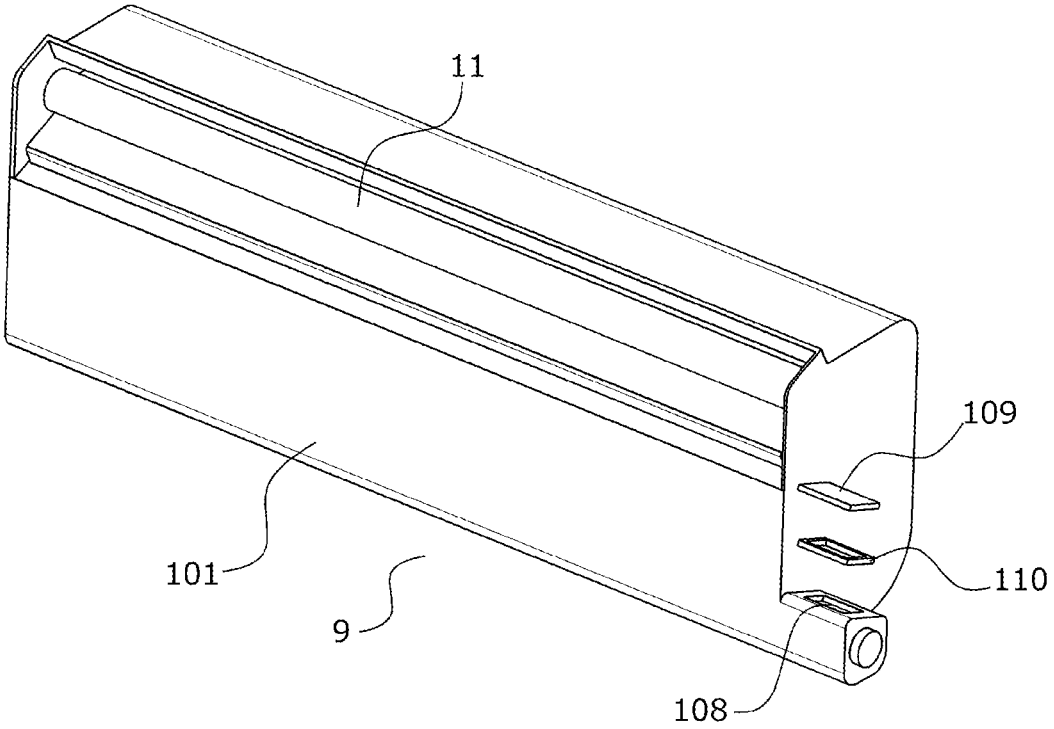
FIG. 2 is a perspective view of a developing apparatus 9 according to the first embodiment of the present invention.

FIG. 2 is a perspective view of one of the developing apparatuses 9 when seen from its rear. The developing apparatus 9 includes a developing roller 11, a developer-container toner receiving opening 108, a developer-container receiving shutter 109, and a developer-container receiving port seal 110 that fills the gap between the developer-container toner receiving opening 108 and the developer-container receiving shutter 109. The developer-container receiving port seal 110 is a sealing member made of an elastic member such as rubber. In FIG. 2, the developer-container toner receiving opening 108, the developer-container receiving shutter 109, and the developer-container receiving port seal 110 are separately drawn for describing configurations. However, the developer-container receiving port seal 110 is generally configured to be integrated with the developer-container receiving shutter 109. The developer-container receiving shutter 109 is held by a developing frame body 101 so as to be slidable. During a period in which the developing apparatus 9 is not attached to the image forming apparatus 1, the developer-container receiving shutter 109 closes the developer-container toner receiving opening 108. When the developing apparatus 9 is attached to the image forming apparatus 1, the developer-container receiving shutter 109 contacts a protrusion (not shown) provided in the body of the image forming apparatus 1. As a result, the developer-container receiving shutter 109 slides, and the developer-container toner receiving opening 108 is opened. The opened developer-container toner receiving opening 108 receives toner that has been transported from the toner transporting apparatus 14 inside the developing apparatus 9 and supplies the received toner to the developing roller 11.

Hereinafter, detailed configurations related to the present invention will be described.

Details of Toner Cartridge

Figure 3A:
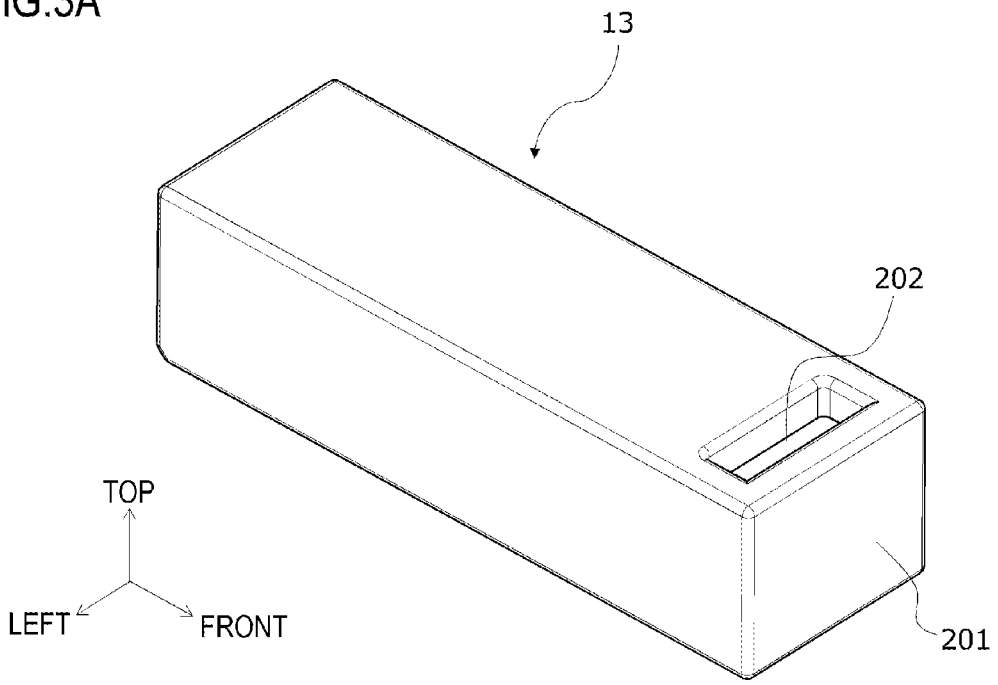
FIGS. 3A and 3B are perspective views of a toner cartridge 13 according to the first embodiment of the present invention.
Figure 3B:
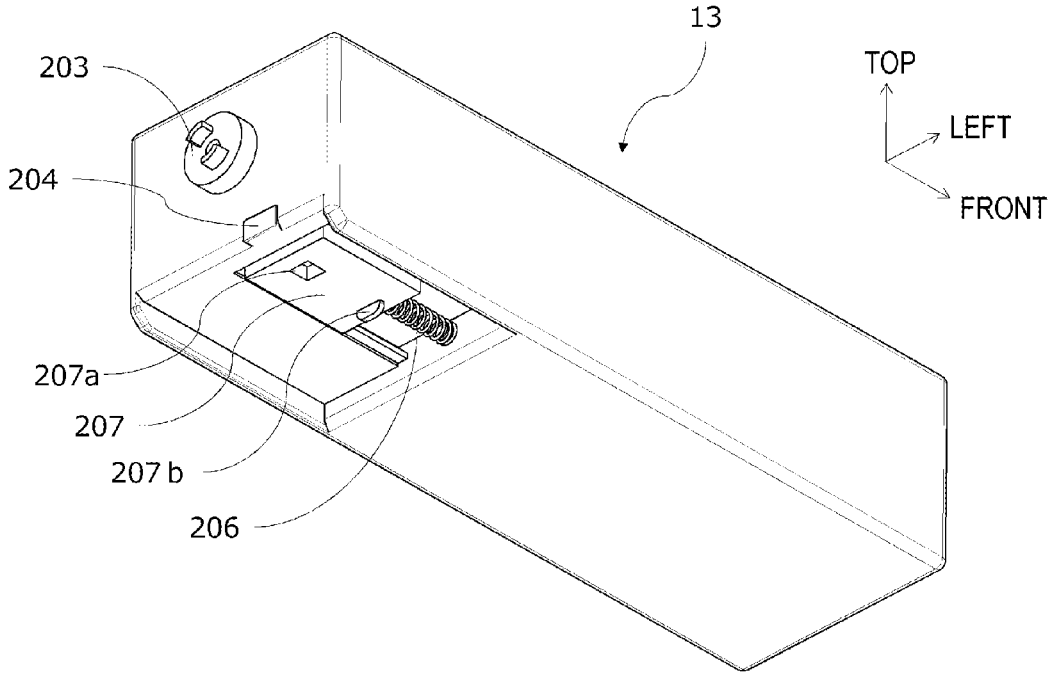

FIG. 3A is a perspective view of one of the toner cartridges 13 when seen from an upper part on its left front side. FIG. 3B is a perspective view of the toner cartridge 13 when seen from a lower part on its left rear side. As shown in FIGS. 3A and 3B, the toner cartridge 13 has a substantially rectangular parallelepiped container body 201 of which the longitudinal direction is an attachment and detachment direction (insertion and extraction direction) in which the toner cartridge 13 is attached to and detached from the apparatus body of the image forming apparatus 1, and accommodates toner inside the container body 201. Note that the present embodiment describes a configuration in which the attachment and detachment direction (longitudinal direction) corresponds to the front-rear direction of the image forming apparatus, but the attachment and detachment direction is not limited to the front-rear direction. Further, the present embodiment describes a configuration in which the container body 201 has a substantially rectangular parallelepiped shape, but the shape of the container body 201 is not limited to the substantially rectangular parallelepiped shape. Even if the container body 201 has, for example, a cylindrical shape, the effect of the present invention remains the same. The toner cartridge 13 has a gripping part 202 on the front side of its upper wall part. The gripping part 202 is constituted by a recessed part of the upper surface of the container body 201. A user is allowed to extract the toner cartridge 13 with his/her finger put on the gripping part 202 of the toner cartridge 13 discharged from the apparatus body.

As shown in FIG. 3B, the toner cartridge 13 has a driving coupling 203 on its rear wall surface so as to be rotatable.

The driving coupling 203 is coupled to a screw (not shown) inside the container body 201. When attached to the inside of the image forming apparatus 1, the driving coupling 203 engages a body-side driving coupling (not shown) to transmit driving.

The toner cartridge 13 has a second contact portion 204 on its rear wall surface to contact a first contact portion 314 (FIG. 5) that will be described later. The second contact portion 204 has a protruding shape with a rectangular cross section that is a protruding part of the rear wall surface. The second contact portion 204 is arranged on the rear side in the front-rear direction of the apparatus body of a toner cartridge shutter 207 that will be described later and placed at almost the same position as the first contact portion 314 in its horizontal and vertical directions.

The container body 201 has the toner cartridge shutter 207 (hereinafter called a shutter 207) that serves as a second shutter member, a toner cartridge shutter spring 206 (hereinafter called a shutter spring 206), and a second opening seal 208 on the rear wall side of its lower wall part. The second opening seal 208 is a sealing member made of an elastic member such as rubber.

Figure 4:
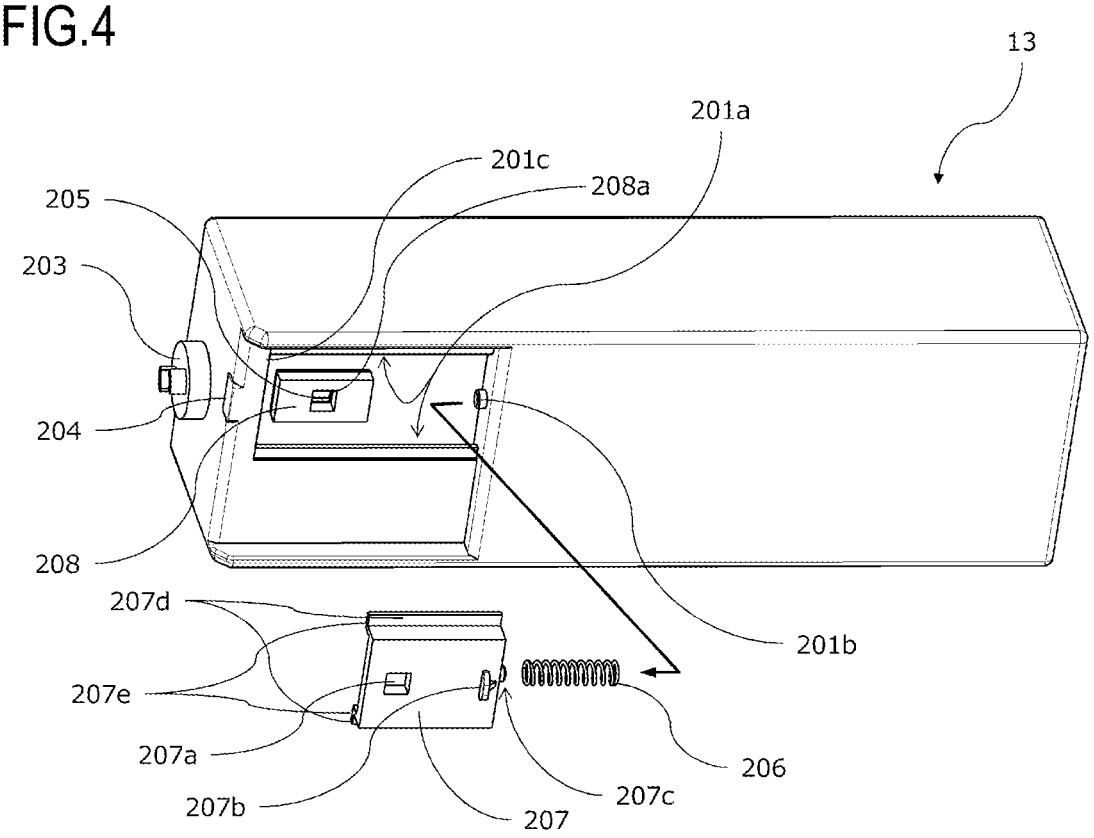
FIG. 4 is a perspective view of the constituting parts of the toner cartridge 13 according to the first embodiment of the present invention.

FIG. 4 is a perspective view of the toner cartridge 13 when seen from its lower side with the shutter 207 and the shutter spring 206 removed therefrom. As shown in FIG. 4, the container body 201 has, on the rear wall side of its lower wall part, a second opening (supplying port) 205 constituted by a substantially square hole to supply the toner inside the container body 201. At the peripheral wall part of the second opening 205, the second opening seal 208 is affixed by a double-sided tape. At the central part of the second opening seal 208, a communication hole 208*a* having substantially the same shape as that of the second opening 205 is made. The second opening seal 208 is affixed to the lower wall of the container body 201 so that the second opening 205 is aligned with the communication hole 208*a*. The second opening seal 208 is compressed between the container body 201 and the shutter 207 when the shutter 207 is attached to the container body 201 and prevents the leakage of the toner from the space between the container body 201 and the shutter 207. Further, the container body 201 has, on the rear side of the second opening seal 208, a second abutting surface 201*c* that is a wall extending downward from the affixed surface of the second opening seal 208. The second abutting surface 201*c* contacts second restricting parts 207*e* of the shutter 207 that will be described later.

The shutter 207 has a rectangular flat plate shape and has an opening hole (first communication hole) 207*a*, a fourth contact portion 207*b*, a supporting boss 207*c*, flange parts 207*d*, and the second restricting parts 207*e*.

The shutter 207 has a pair of the flange parts 207*d* that protrudes in right and left directions with respect to the longitudinal direction of the container body 201 and extends in the longitudinal direction. On the other hand, the container body 201 has a pair of groove parts 201*a* that is recessed in the right and left directions and extends in the longitudinal direction. The shutter 207 is assembled to the container body 201 so that the flange parts 207*d* are fitted into the groove parts 201*a*, and held so as to be freely slidable (freely relatively movable) with respect to the container body 201 when the flange parts 207*d* slide along the longitudinal direction inside the groove parts 201*a*.

In the shutter 207, the opening hole 207*a* larger than the second opening 205 is made. When the second opening 205 and the communication hole 208*a* are aligned with (overlapped with) the opening hole 207*a*, it is possible to discharge the toner from the inside of the container body 201 to the outside (it is possible to supply the toner inside the container body 201 to the side of the apparatus body).

The shutter 207 has the cylindrical supporting boss 207*c* extending in a front direction on its front side (right side in FIG. 4) and supports the inner diameter of the shutter spring 206 that will be described later. The fourth contact portion 207*b* has a rib shape that protrudes downward from the shutter 207 and is long on the right and left sides with respect to a sliding direction. When the toner cartridge 13 is attached and detached, the fourth contact portion 207*b* contacts a body-side third contact portion 315 (FIG. 5) that will be described later.

The shutter spring 206 is a compression spring and attached so that one end thereof is held by a boss 201*b* that is provided on the lower wall of the container body 201 and extends to the rear side, and so that the other end thereof is held by the supporting boss 207*c* of the shutter 207. The shutter spring 206 is compressed in the front-rear direction between the container body 201 and the shutter 207 and urges the shutter 207 to the rear side with respect to the container body 201. During a period in which the toner cartridge 13 is not attached to the image forming apparatus 1, the shutter 207 is supported with the second restricting parts 207*e* of a lateral surface on the rear side of the shutter 207 and the second abutting surface 201*c* of the container body 201 contacting each other against the urging force of the shutter spring 206. At this time, the shutter 207 closes the second opening 205.

Details of Toner Transporting Apparatus 14

Figure 5:
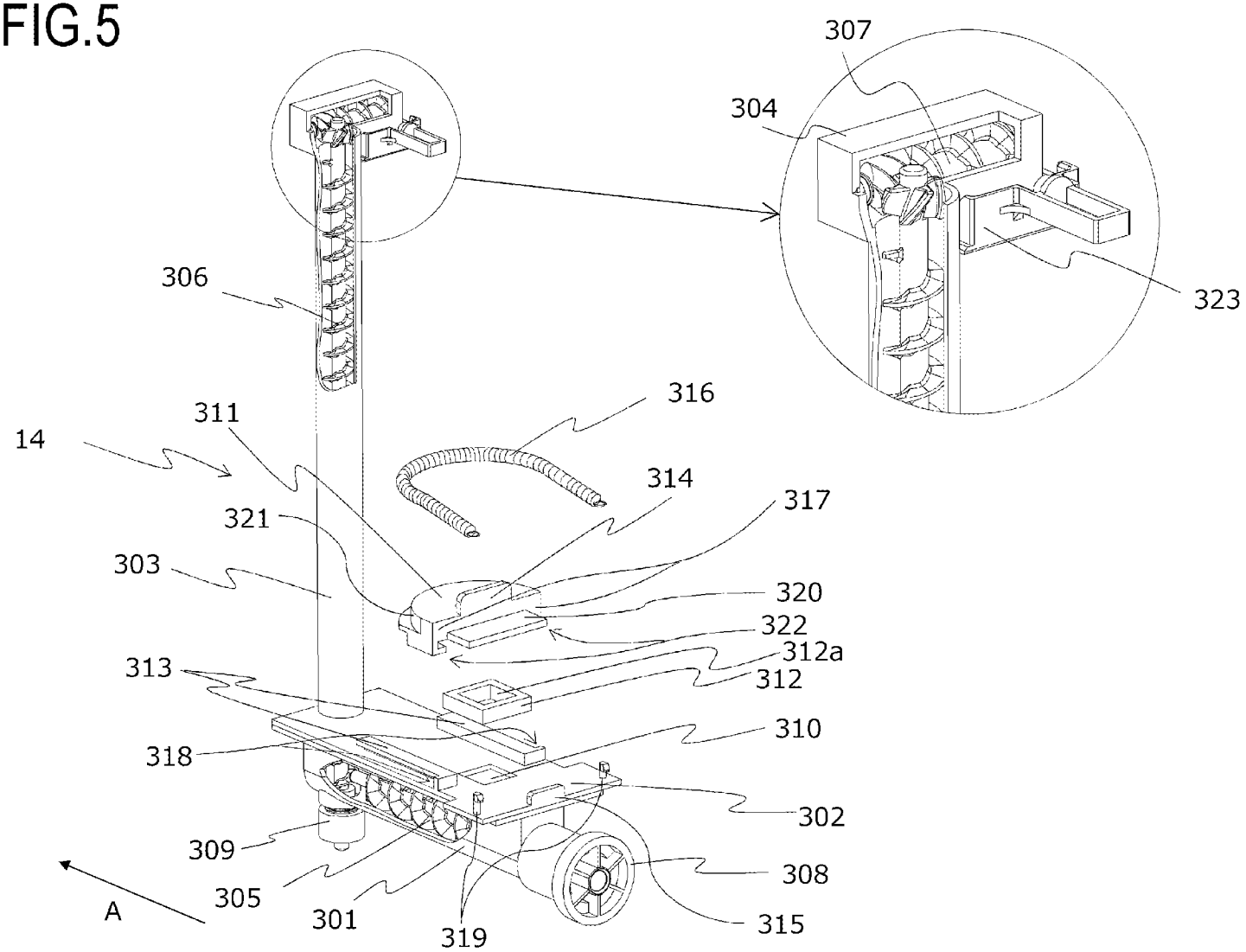
FIG. 5 is a perspective view of a toner transporting apparatus 14 according to the first embodiment of the present invention.

FIG. 5 is a perspective view of one of the toner transporting apparatuses 14 when seen from its front. In the toner transporting apparatus 14, a duct for transporting the toner is constituted by a toner receiving container (developer receiving part) 301, a cover member 302, an intermediate pipe 303, and a discharging-part pipe 304. In FIG. 5, a part of the duct is cut away to make its inner side visible for the clarification of a description. A toner horizontally-transporting member 305, a toner upwardly-transporting member 306, and a toner discharging-part transporting member 307 are resin screws having a spiral shape and accommodated in the toner receiving container 301, the intermediate pipe 303, and the discharging-part pipe 304, respectively, so as to be rotatable. Note that the intermediate pipe 303 and the toner upwardly-transporting member 306 are formed to be long and integrated with each other in the present embodiment but may be divided into pieces in their assembling standpoint. The toner horizontally-transporting member 305 is rotated by a driving force transmitted from the outside of the toner receiving container 301 via an engaged horizontal screw driving gear 308. The toner upwardly-transporting member 306 is rotated by the driving force transmitted from the outside of the toner receiving container 301 via an engaged upward screw driving gear 309. The toner discharging-part transporting member 307 is rotated by the driving force transmitted from the toner upwardly-transporting member 306. The transmission of the driving force between the screws is performed in such a manner that blades having a helical gear shape with a twisting angle of 45° are rotated. Note that even with means for driving and connecting the respective screws different from that of the present embodiment, the effect of the present invention remains the same.

The cover member 302 is provided on the toner receiving container 301 in a close contact state so as to prevent the leakage of the toner inside the container and has a first opening (receiving port) 310, first shutter rails 313, the third contact portion 315, first restricting parts 318, and spring hooks 319. The first opening 310 is a hole larger than the opening hole 207*a* of the shutter 207 described above, communicates with the inside of the toner receiving container 301, and receives the toner supplied from the second opening 205 of the toner cartridge 13 attached to the inside of the image forming apparatus 1. The first shutter rails 313 have a long rib shape extending in the front-rear direction on the right and left sides of the cover member 302 and engage rail grooves 322 of a first shutter member 311 that will be described later to restrict the operation of the first shutter member 311. The third contact portion 315 has a rib shape that extends in the upper direction from the front edge of the cover member 302 and is long on the right and left sides. The shutter 207 may be opened when the front surface of the third contact portion 315 contacts the fourth contact portion 207*b* of the shutter 207. The first restricting parts 318 have a wall shape extending perpendicularly on the front side of the right and left first shutter rails 313. The first restricting parts 318 contact first abutting surfaces 317 of the first shutter member 311 that will be described later to restrict the first shutter member 311 at a closed position. The spring hooks 319 are two circular bosses extending in the upper direction from the upper surface of the cover member 302 and arranged on the front side of the first restricting parts 318.

On the cover member 302, the first shutter member 311, a first sealing member 312 for filling the gap between the first opening 310 and the first shutter member 311, and a first shutter spring 316 (first urging member) are provided. The first sealing member 312 is a sealing member made of an elastic member such as rubber. In FIG. 5, the first shutter spring 316, the first shutter member 311, and the first sealing member 312 are separately drawn for describing configurations. Actually, the first sealing member 312 is provided so as to be in close contact with the cover member 302 by a double-sided tape. Further, the first shutter member 311 is provided so as to be slidable (relatively movable) with respect to the cover member 302 in the front-rear direction (direction indicated by arrow A) along the first shutter rails 313 provided on the cover member 302 at a height at which the first shutter member 311 is in close contact with the first sealing member 312.

At the central part of the first sealing member 312, a communication hole 312*a* having substantially the same shape as that of the first opening 310 is made. As described above, the first sealing member 312 is affixed onto the upper surface of the cover member 302 by a double-sided tape so that its hole position is aligned with the first opening 310.

The first shutter member 311 has a wall part 320, the first contact portion 314, the first abutting surfaces 317, a spring restricting part 321, and rail grooves 322. The wall part 320 has a flat plate shape extending in the horizontal direction. When the lower surface of the wall part 320 is positioned at the upper part of the communication hole 312*a* of the first sealing member 312, the wall part 320 prevents the leakage of the toner from the first opening 310. The first contact portion 314 has a rib shape that protrudes vertically upward from the wall part 320 and is long on the right and left sides. When the front surface of the first contact portion 314 contacts or separates from the second contact portion 204 of the toner cartridge 13, the first shutter member 311 is opened and closed. The rail grooves 322 are grooves that are provided on the right and left sides of the wall part 320, have a recess-shaped cross section, and extend in the front-rear direction. Each of the rail grooves 322 is directed inward. When the rail grooves 322 engage the first shutter rails 313 of the cover member 302, the first shutter member 311 becomes slidable in the front-rear direction (direction indicated by the arrow A) with respect to the cover member 302 as described above. The first abutting surfaces 317 are surfaces extending in a vertical direction on the front side of the rail grooves 322. When receiving the urging force of the first shutter spring 316 that will be described later, the first abutting surfaces 317 contact the first restricting parts 318 of the cover member 302. The first shutter member 311 is restricted at a closed position (first closed position) by the urging force of the first shutter spring 316 unless the urging force of the first shutter spring 316 acting on the first shutter member 311 reduces by the insertion of the toner cartridge 13 or the like. The spring restricting part 321 is a wall that has an arc-shaped cross section and extends in the upper direction. By making the lateral surface of the first shutter spring 316 contact the outer diameter of the spring restricting part 321, the first shutter member 311 is urged to the front side of the apparatus body.

The first shutter spring 316 is a tensile spring, and its both ends are put on the two spring hooks 319 of the cover member 302. As described above, the first shutter member 311 is urged to the front side of the apparatus body by making the lateral surface of the spring put on the spring restricting part 321 of the first shutter member 311. When the toner cartridge 13 is not attached, the first abutting surfaces 317 of the first shutter member 311 are brought into contact with the first restricting parts 318 of the cover member 302 by the urging force of the first shutter spring 316 as described above. As a result, the first shutter member 311 is restricted at a position (first closed position) at which the wall part 320 closes the first opening 310.

The toner supplied from the toner cartridge 13 flows into the toner receiving container 301 from the first opening 310, is transported by respective toner transporting members, and is discharged from a discharging port (not shown) provided on the discharging-part pipe 304. The discharging port has a discharging-part shutter 323 provided so as to be slidable in the direction indicated by the arrow A. When the developing apparatus 9 is attached, the discharging-part shutter 323 slides and opens the discharging port. Further, a seal (not shown) for filling the gap between the toner discharging port and the discharging-part shutter 323 is provided.

Figure 6A:
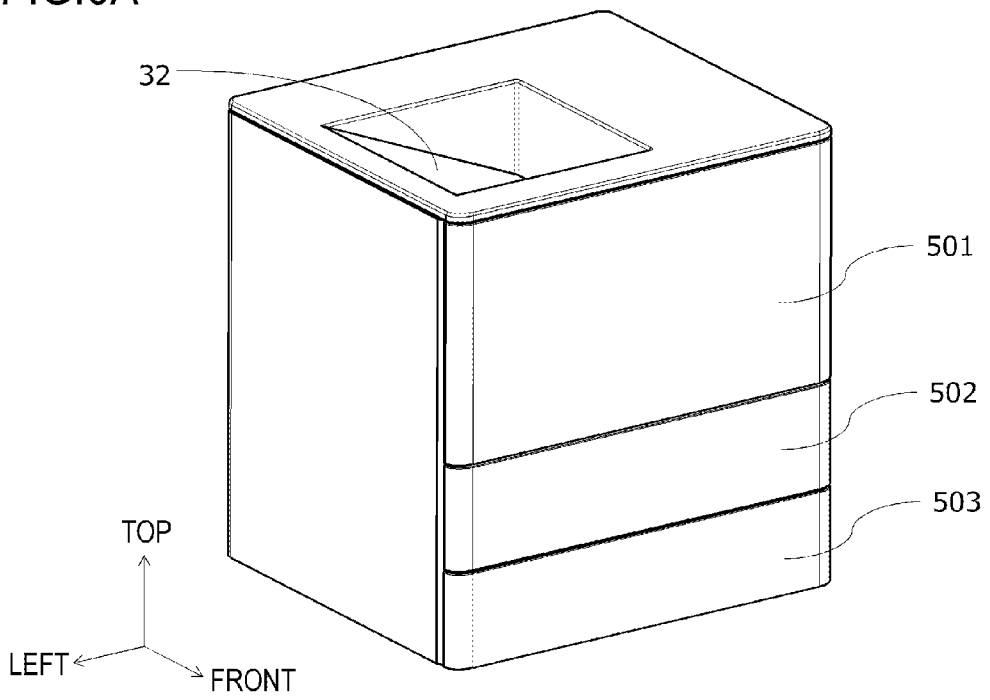
FIGS. 6A and 6B are perspective views of the image forming apparatus 1 according to the first embodiment of the present invention.
Figure 6B:
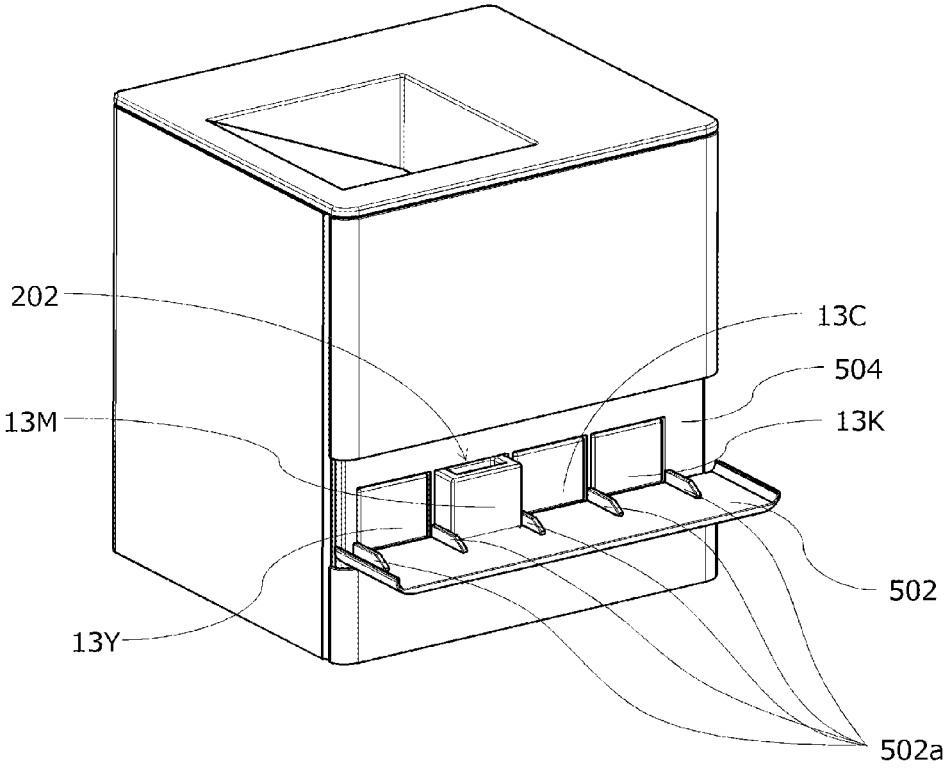

FIGS. 6A and 6B are perspective views of the image forming apparatus 1 when seen from an upper part on its left side. FIG. 6A is a perspective view of the image forming apparatus 1 with its all doors closed. FIG. 6B is a perspective view of the image forming apparatus 1 with a toner cartridge door 502 opened and the toner cartridge 13M discharged.

As shown in FIG. 6A, the front surface of the image forming apparatus 1 is constituted by three exterior bodies arranged vertically. An upper exterior body 501 is a door opened and closed when the image forming stations 6Y, 6M, 6C, and 6K or the toner collecting container 24 is replaced. A central exterior body 502 (hereinafter called a toner cartridge door) is a door opened and closed when the toner cartridges 13 are replaced. A lower exterior body 503 is a front cover fixed to the cassette 2.

As shown in FIG. 6B, access to the toner cartridges 13 is allowed when the toner cartridge door 502 is opened and closed with its lower side as a fulcrum (not shown) to replace the toner cartridges 13. On the inner wall of the toner cartridge door 502, five guide ribs 502*a* are provided so as to extend in the front-rear direction with the door opened. The attachment and detachment of the toner cartridges 13 is allowed when the guide ribs 502*a* are used as guides.

On the inner side of the toner cartridge door 502, an inner cover 504 is provided. The inner cover 504 has an opening slightly larger than the cross section of the toner cartridges 13. The attachment of the toner cartridges 13 is allowed via the opening. Further, positions in the vertical and horizontal directions on the front side of the toner cartridges 13 are restricted when the toner cartridges 13 are attached. Positions in the front-rear direction of the toner cartridges 13 are restricted by a restricting member 506.

Figure 8A:
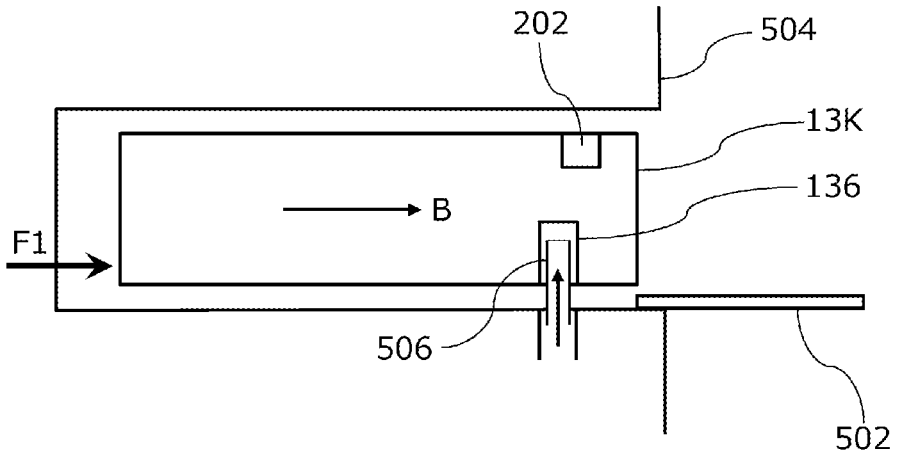
FIGS. 8A and 8B are schematic views of a configuration for discharging and restricting the toner cartridge 13 according to the first embodiment of the present invention.

FIG. 8A is a schematic cross-sectional view showing a state in which the discharging of one of the toner cartridges 13 from the apparatus body is restricted by the restricting member 506 (a state in which the toner cartridge 13 is placed at a first position which is a position to perform image formation and a position in which the toner is supplied to the apparatus body from the toner cartridges 13). The container body 201 of the toner cartridge 13 has an engaged part 136 at which the restricting member 506 provided in the apparatus body is engageable. The restricting member 506 is configured to be movable to and retractable from an engaging position at which the restricting member 506 engages the engaged part 136 and a non-engaging position at which the restricting member 506 does not engage the engaged part 136 by the control of an operation panel. As will be described later, an urging force F1 is applied by the first shutter spring 316 to the container body 201 placed at a prescribed attachment position (attachment complete position) in the apparatus body in a direction in which the cartridge 13 is discharged to the outside of the apparatus body (a direction from the rear side to the front side). In a state in which the restricting member 506 engages the engaged part 136, the movement of the container body 201 of the toner cartridge 13 from the attachment complete position in the apparatus body to the outside of the apparatus body is restricted.

Figure 8B:
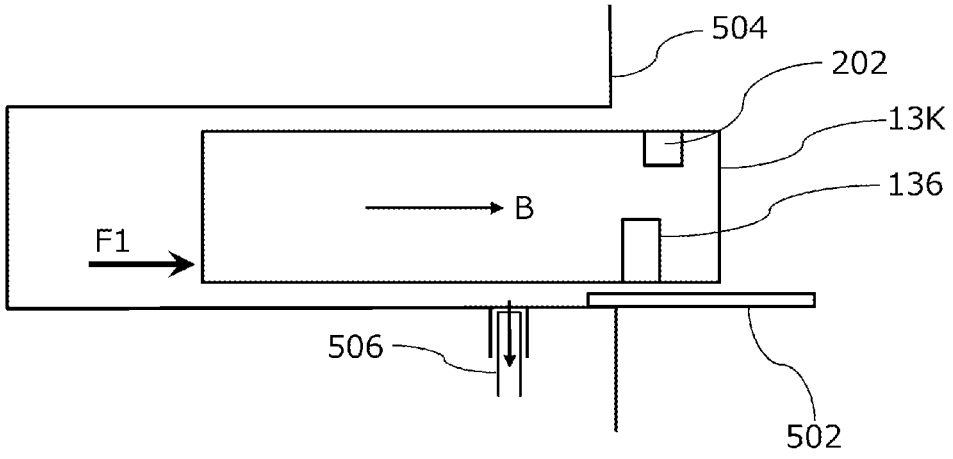

FIG. 8B is a schematic cross-sectional view showing a state in which a part of the toner cartridge 13 including the gripping part 202 is discharged so as to be exposed to the outside of the apparatus body when restriction by the restricting member 506 is cancelled (a state in which the toner cartridge 13 is placed at a second position which is a positon downstream of the first position in a discharging direction of the toner cartridge 13 or a position where the toner cartridge 13 is to be replaced). When the restricting member 506 retracts up to the non-engaging position at which the restricting member 506 does not engage the engaged part 136, the toner cartridge 13 moves in a discharging direction (to the front side of the body) with the operation of the urging force F1 of a prescribed size. As a result, the gripping part 202 is exposed to the outside of the apparatus body.

Note that the configuration for discharging and restricting the toner cartridge 13 described here is just an example. The discharging and restricting of the toner cartridge 13 is not limited to the above configuration.

Referring back to FIG. 6B, the front sides of the upper surfaces of the toner cartridges 13 are covered with the inner cover 504, whereby access to the gripping parts 202 is not allowed. When any of the toner cartridges 13 is replaced, the target toner cartridge 13 moves to the front side of the body. As a result, the gripping part 202 is exposed to the outside of the apparatus, and the user is allowed to draw the target toner cartridge 13 with his/her finger put on the gripping part 202. In the replacement of the toner cartridge 13, the running-out of the toner is detected by detecting means not shown, and a message urging the replacement of the target toner cartridge 13 is displayed on the operation panel not shown. Then, the user selects the toner cartridge 13 to be replaced on the operation panel to discharge the target toner cartridge 13. In the present embodiment, the movement and retraction of the restricting member 506 is controlled by the operation of the operation panel to discharge the toner cartridges 13. However, the discharging of the toner cartridges 13 is not limited to the operation of the operation panel. For example, the toner cartridges 13 may be discharged when buttons provided on the upper sides of the respective toner cartridges 13 in the inner cover 504 are pressed.

The operation of the present embodiment will be described with reference to FIGS. 7A to 7D using the configurations described above. FIGS. 7A to 7D are cross-sectional views of the image forming apparatus 1 when seen from its left side via the center of the first opening 310.

Figure 7A:
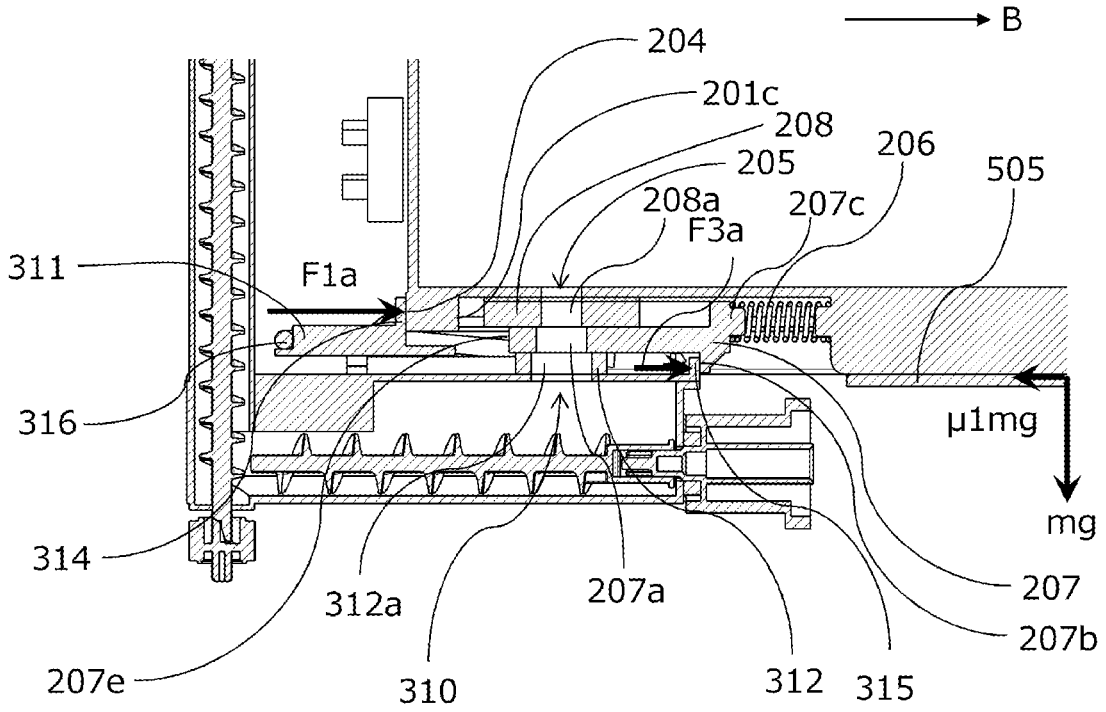
FIG. 7A is a cross-sectional view showing each discharging process of the toner cartridge 13 according to the first embodiment of the present invention.

FIG. 7A is a cross-sectional view showing a state at the moment at which the restriction by the restricting member 506 described above is cancelled in a state in which the toner cartridge 13 is attached to the image forming apparatus 1.

Figure 7B:
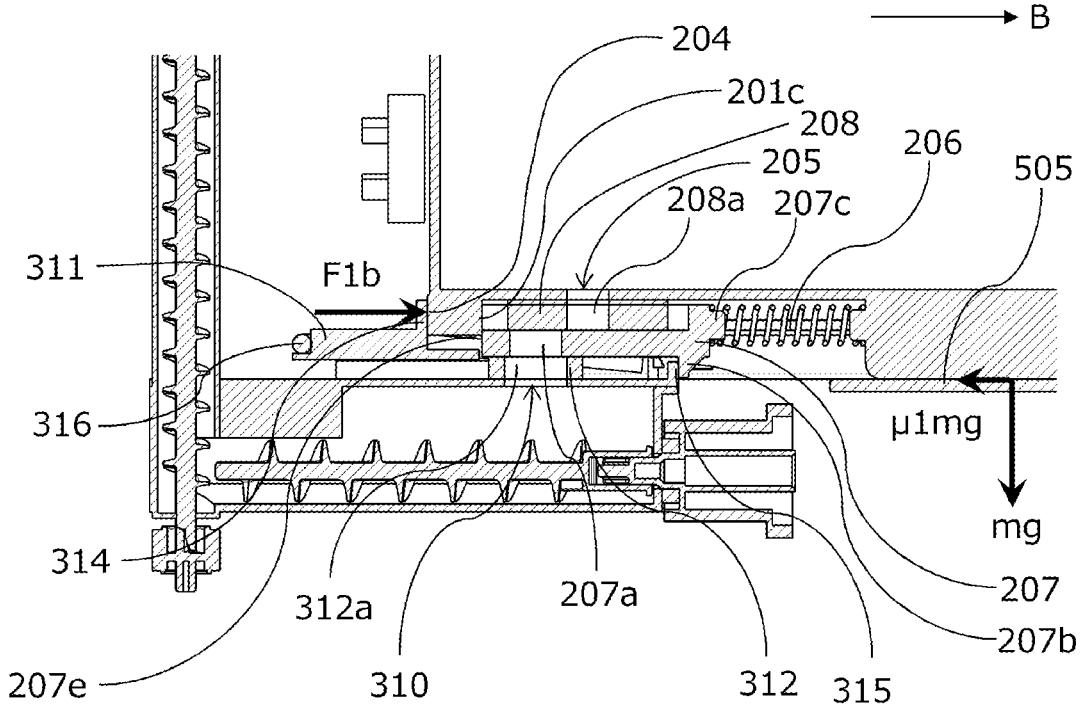
FIG. 7B is a cross-sectional view showing each discharging process of the toner cartridge 13 according to the first embodiment of the present invention.

FIG. 7B is a cross-sectional view showing a state right before the fourth contact portion 207*b* of the shutter 207 is separated from the third contact portion 315 of the cover member 302 when only the container body 201 moves in the discharging direction of the toner cartridge 13 from the state shown in FIG. 7A.

Figure 7C:
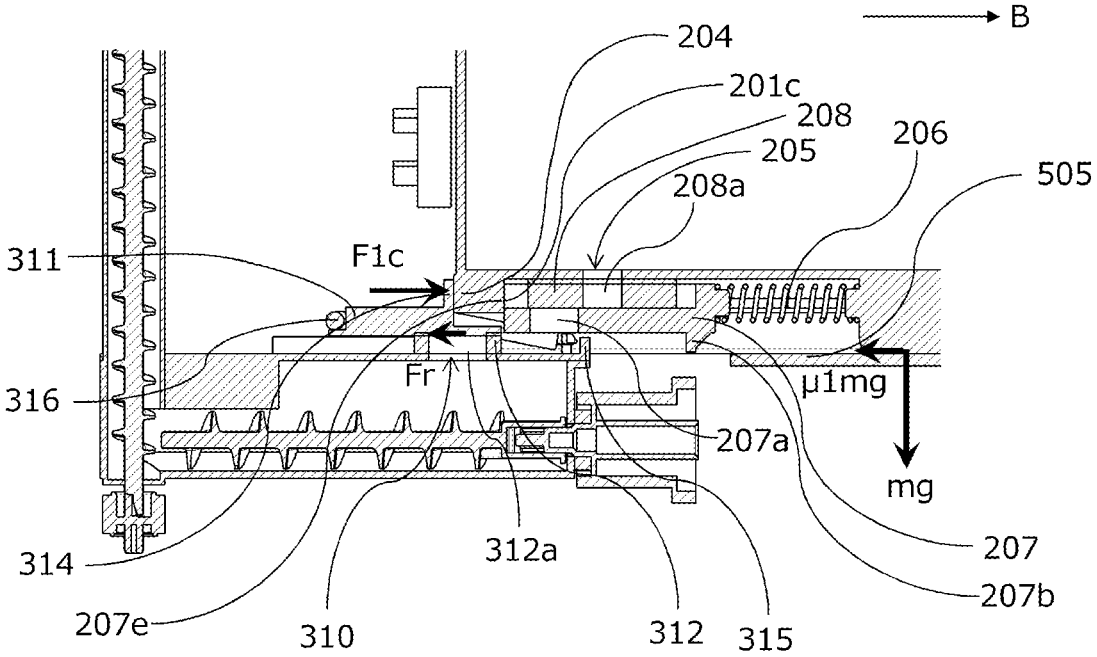
FIG. 7C is a cross-sectional view showing each discharging process of the toner cartridge 13 according to the first embodiment of the present invention.

FIG. 7C is a cross-sectional view showing a state right before the first contact portion 314 of the first shutter member 311 is separated from the second contact portion 204 of the toner cartridge 13 (the container body 201) when the toner cartridge 13 is further discharged from the state shown in FIG. 7B.

Figure 7D:
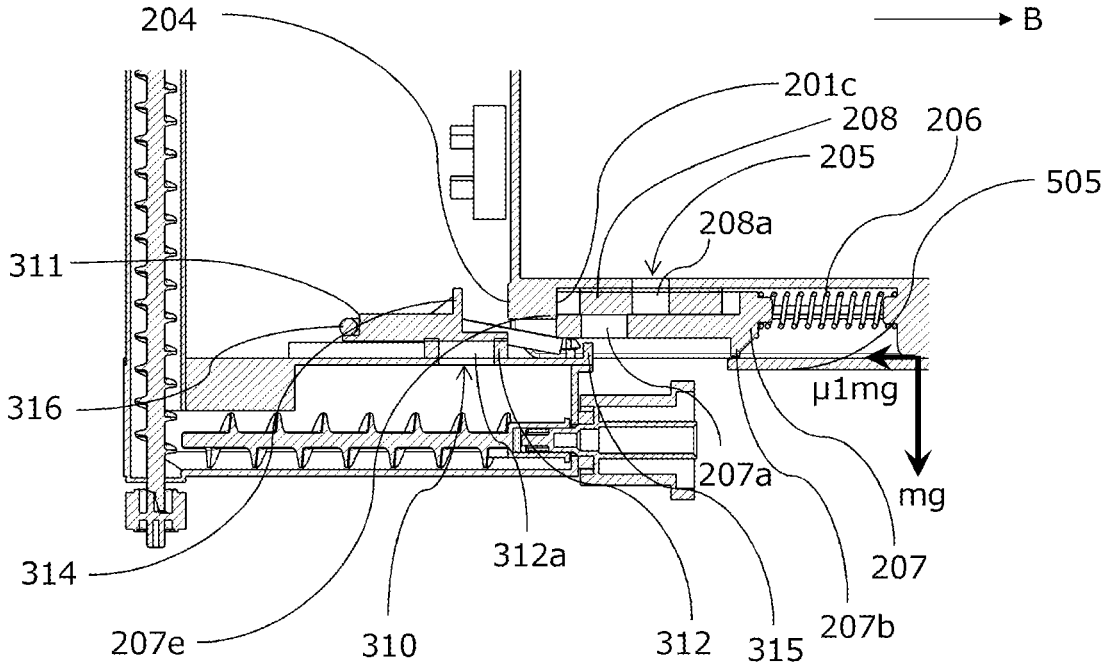
FIG. 7D is a cross-sectional view showing each discharging process of the toner cartridge 13 according to the first embodiment of the present invention.

FIG. 7D is a cross-sectional view showing a state in which the first contact portion 314 is completely separated from the second contact portion 204 when the toner cartridge 13 is further discharged from the state shown in FIG. 7C.

As shown in FIG. 7A, the first opening 310 and the second opening 205 are in communication with each other in a state in which the toner cartridge 13 is attached to the image forming apparatus 1. The shutter 207 is put in a state in which the fourth contact portion 207*b* contacts the third contact portion 315 of the cover member 302 against the urging force of the shutter spring 206 and the second restricting parts 207*e* are separated from the second abutting surface 201*c*. Further, the first shutter member 311 is put in a state in which the first contact portion 314 contacts the second contact portion 204 of the toner cartridge 13 against the urging force of the first shutter spring 316. At this time, the toner cartridge 13 receives the urging force of the first shutter spring 316 as a force Fla (hereinafter called a first contact force) on the front side of the apparatus body (in a direction indicated by arrow B in FIG. 7A) from the first contact portion 314 at the second contact portion 204 of the container body 201. In addition, the toner cartridge 13 receives a force F3*a* (hereinafter called a third contact force) on the front side of the apparatus body (in the direction indicated by the arrow B), which is obtained by subtracting the sliding resistance between the shutter 207 and the second opening seal 208 from the urging force of the shutter spring 206, from the third contact portion 315 of the cover member 302 at the fourth contact portion 207*b* of the shutter 207. When the toner cartridge 13 is attached to the inside of the image forming apparatus 1, these forces on the front side of the apparatus body are restricted by the restricting member 506 shown in FIGS. 8A and 8B to place the toner cartridge 13 at an image forming position serving as the attachment complete position while preventing the same from being discharged.

When the toner cartridge 13 is discharged, the restriction by the restricting member 506 is cancelled by the cancelling means of the restricting member 506 to discharge the toner cartridge 13 using the urging forces described above. When the toner cartridge 13 is discharged, the toner cartridge 13 is guided by a toner cartridge rail 505 serving as a rail member provided on the lower side of the toner cartridge 13 inside the image forming apparatus 1. In this manner, the attachment and detachment of the toner cartridge 13 is allowed. At this time, a frictional force is generated between the toner cartridge 13 and the toner cartridge rail 505, but the urging forces described above are made lager than the frictional force to allow the discharging of the toner cartridge 13. The spring pressure of the first shutter spring 316 is set so that the following relational expression is established when the mass of the toner cartridge 13 at replacement is m, the gravitational acceleration thereof is g, and a static friction coefficient between the toner cartridge rail 505 and the toner cartridge 13 is μ1.

$$F1a+F3a>\mu 1mg$$

The frictional force μ1 mg may be measured by extracting the toner cartridge 13 in a state in which the toner cartridge 13 is put on the toner cartridge rail 505 with its front side fixed to the movable part of a spring balance.

Further, the mass m of the toner cartridge 13 at the replacement is a weight at a timing at which the attachment of a new toner cartridge 13 becomes necessary when the remaining amount of the accommodated toner is not enough to continue image formation after the toner is consumed.

When the discharging of the toner cartridge 13 starts from the state shown in FIG. 7A, only the container body 201 moves in the discharging direction with the shutter 207 remaining at the same position as shown in FIG. 7B. As a result, the second restricting parts 207*e* of the shutter 207 contact the second abutting surface 201*c* of the container body 201. In this state, the second opening 205 is closed by the shutter 207. At the same time, the operation of the urging force of the shutter spring 206 on the third contact portion 315 of the cover member 302 contacting the fourth contact portion 207*b* of the shutter 207 is cancelled. The urging force of the shutter spring 206 is received at the contact portion between the second restricting parts 207*e* of the shutter 207 and the second abutting surface 201*c* of the container body 201. Therefore, the toner cartridge 13 does not receive the urging force of the shutter spring 206 as an external force (the urging force of the shutter spring 206 is completed inside the toner cartridge 13). At this time, the first opening 310 is not closed by the first shutter member 311, the first contact portion 314 of the first shutter member 311 continuously contacts the second contact portion 204 of the container body 201, and the opening hole 207*a* of the shutter 207 is continuously in communication with the first opening 310. The spring pressure is set so that the following relational expressions are established when a first contact force is F1*b* and a third contact force is F3*b* at this time.

$$F3b=0$$

$$F1b>\mu 1mg$$

When the toner cartridge 13 is further discharged from the state shown in FIG. 7B, the fourth contact portion 207*b* of the shutter 207 is completely separated from the third contact portion 315 of the cover member 302 as shown in FIG. 7C. Until the first abutting surfaces 317 contact the first restricting parts 318 of the cover member 302 (see FIG. 5), the first contact portion 314 of the first shutter member 311 continuously contacts the second contact portion 204 of the container body 201 (the contacting state between the first contact portion 314 and the second contact portion 204 is maintained). Accordingly, the toner cartridge 13 continuously receives the urging force of the first shutter spring 316 in this state. Further, the first shutter member 311 moves in close contact with the first sealing member 312 and therefore receives a frictional force corresponding to a repulsive force from the first sealing member 312. The urging force of the first shutter spring 316 is set so that the following relational expression is established when a first contact force right before the first abutting surfaces 317 contact the first restricting parts 318 is F1*c* and the sliding resistance force between the first shutter member 311 and the first sealing member 312 is Fr.

$$F1c>\mu 1mg+Fr$$

At this time, the toner cartridge 13 is discharged up to a position at which the gripping part 202 is exposed from the inner cover 504 as shown in FIG. 6B. Further, the urging force of the first shutter spring 316 is set so that the following relational expression is established when the mass of the toner cartridge 13 (in a brand-new state in which the amount of the toner is maximum (the toner is full)) is M.

$$F1c<\mu 1Mg+Fr$$

When the first abutting surfaces 317 contact the first restricting parts 318, the first shutter member 311 is restricted by the cover member 302 and is not allowed to move in the discharging direction (B direction). The toner cartridge 13 further moves in the discharging direction according to the momentum (inertia) of the urging force of the first shutter spring 316 that is received from the cover member 302. As a result, the contact between the first contact portion 314 and the second contact portion 204 is cancelled as shown in FIG. 7D, and the toner cartridge 13 does not receive the force on the front side of the image forming apparatus 1.

As described above, the first shutter member 311 for closing the first opening 310 that receives the toner from the toner cartridge 13 of the image forming apparatus 1 has the first contact portion 314 that contacts the second contact portion 204 of the container body 201 of the toner cartridge 13, and the toner cartridge 13 is discharged using the urging force of the first shutter spring 316 that urges the first shutter member 311 according to the present invention. According to the configuration, it is possible to automatically discharge a cartridge with a simple configuration and in a small space.

The first contact portion 314 of the first shutter member 311 contacts the second contact portion 204 provided on the container body 201 of the toner cartridge 13 to make it possible to stably discharge the toner cartridge 13. The second contact portion 204 is provided on the upstream side of the shutter 207 (the fourth contact portion 207*b*) in the discharging direction of the toner cartridge 13 (both the second contact portion 204 and the fourth contact portion 207*b* are arranged so as to be aligned or overlapped with each other when seen in the discharging direction). In this manner, it is possible to prevent the inclination of the toner cartridge 13 caused by moment occurring due to the phase difference between the first contact force F1*a* and the third contact force F3*a* during the discharging of the toner cartridge 13 and realize the stable discharging of the toner cartridge 13.

Figure 9A:
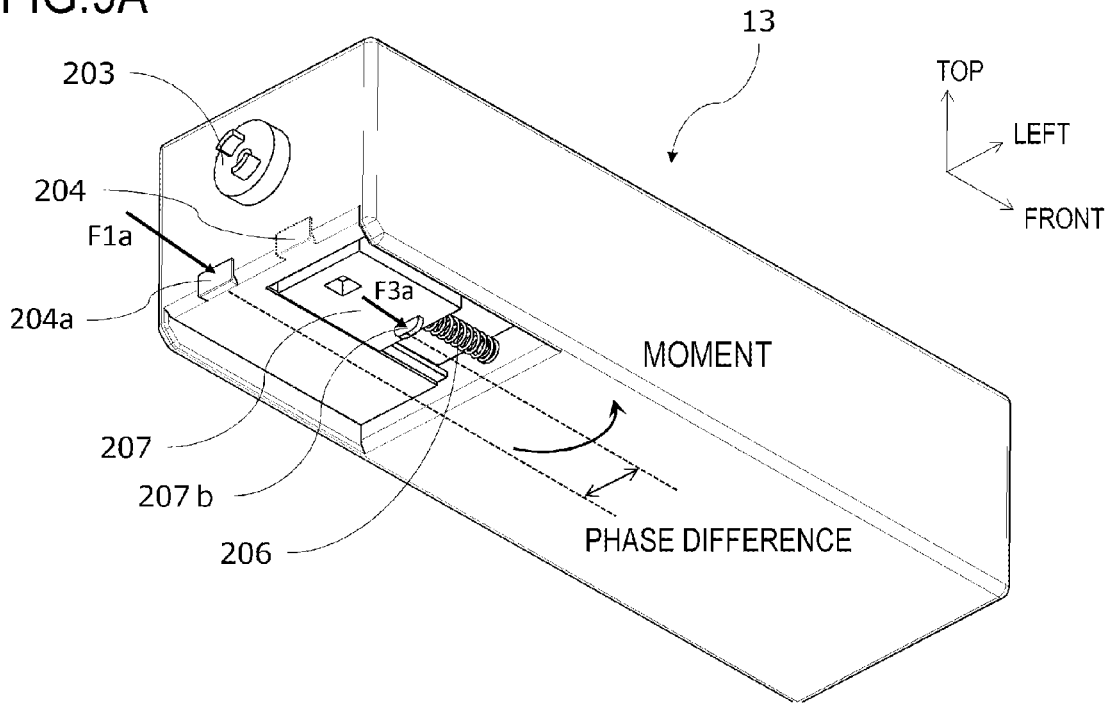
FIGS. 9A and 9B are perspective views showing the configurations of the toner cartridge according to comparative examples.
Figure 9B:
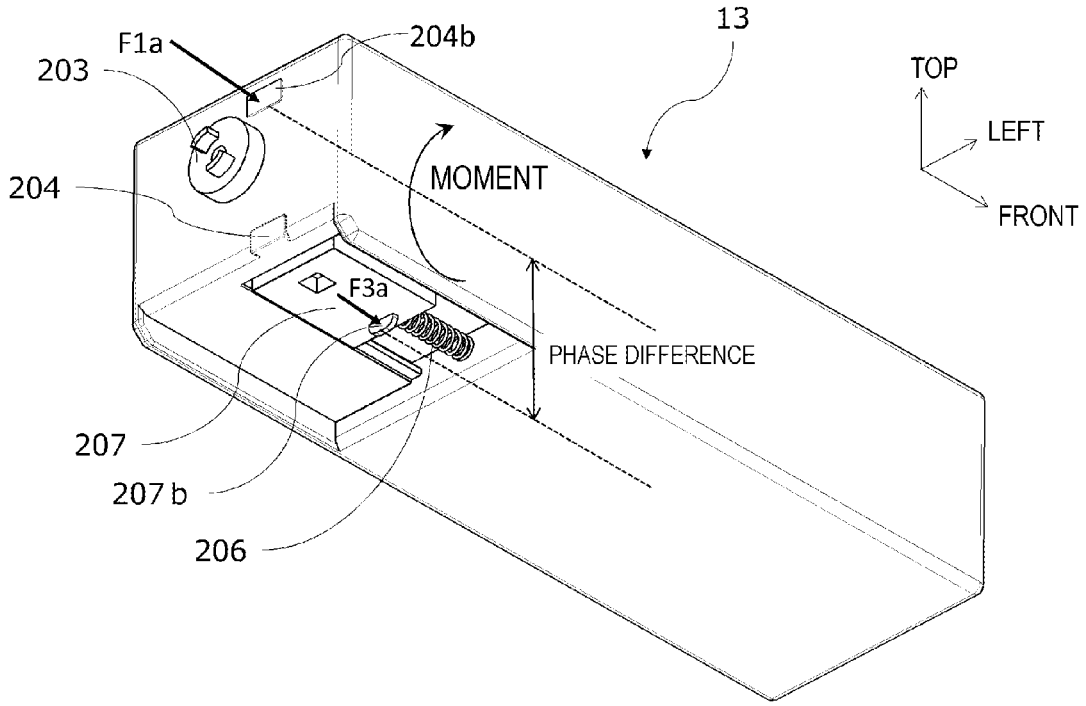

FIGS. 9A and 9B are schematic perspective views showing the configurations of comparative examples in which the arrangement of the second contact portion 204 is different from that of the present embodiment.

A first comparative example shown in FIG. 9A describes a configuration in which a second contact portion 204*a* is arranged at a position shifted to the right side in the horizontal direction from the position of the second contact portion 204 of the present embodiment. Further, a second comparative example shown in FIG. 9B describes a configuration in which a second contact portion 204*b* is arranged at a position shifted to the upper side from the position of the second contact portion 204 of the present embodiment. A phase difference (a distance in a direction orthogonal to the discharging direction) is generated between the third contact force F3*a* received at the fourth contact portion 207*b* of the shutter 207 and the first contact force F1*a* received at the second contact portion 204*a* or 204*b* of the container body 201. On the other hand, the above phase difference of the present embodiment is smaller than those of the first and second comparative examples. That is, the present embodiment is configured so that both the third contact force F3*a* and the first contact force F1*a* are near in place in the direction orthogonal to the discharging direction. Accordingly, it is possible to stably discharge the toner cartridge 13 since moment generated in the toner cartridge 13 is small when the toner cartridge 13 is discharged according to the configuration of the present embodiment.

In addition, when the toner cartridge 13 is discharged, the first contact force F1*b* exceeds the frictional force between the toner cartridge 13 and the toner cartridge rail 505 even in a state in which the shutter 207 completely closes the second opening 205. Therefore, the toner cartridge 13 is allowed to be discharged up to a position at which the shutter 207 is completely closed without stopping in mid course. Accordingly, it is possible to prevent the leakage or scattering of the toner from the second opening 205.

Further, the shutter 207 contacts the cover member 302 fixed to the apparatus body without contacting the first shutter member 311, and thus each of the shutters is independently opened and closed. Accordingly, it is possible to stably discharge the toner cartridge 13 since the urging force of the shutter spring 206 does not have an influence on the urging force of the first shutter spring 316 necessary for discharging the toner cartridge 13. In addition, the degree of freedom in designing a spring is improved.

The first contact force F1*c* right before the first abutting surfaces 317 of the first shutter member 311 contact the first restricting parts 318 of the cover member 302 is larger than the sum of the frictional force between the toner cartridge 13 and the toner cartridge rail 505 and the frictional force between the first shutter member 311 and the first sealing member 312 with respect to the weight of the toner cartridge 13 at the replacement. In this manner, the toner cartridge 13 is allowed to be discharged until the first shutter member 311 completely closes the first opening 310. Accordingly, it is possible to prevent the scattering or leakage of the toner from the first opening 310.

Further, the gripping part 202 of the toner cartridge 13 is hidden by the inner cover 504 in a state in which the toner cartridge 13 is attached to the inside of the image forming apparatus 1. The gripping part 202 of the toner cartridge 13 is exposed from the inner cover 504 at the discharging position of the toner cartridge 13 described above. As a result, it is possible to improve usability since a user easily recognizes the toner cartridge 13 that is a target.

In addition, the first contact force F1*c* right before the first abutting surfaces 317 of the first shutter member 311 contact the first restricting parts 318 of the cover member 302 is smaller than the sum of the frictional force between the toner cartridge 13 and the toner cartridge rail 505 and the frictional force between the first shutter member 311 and the first sealing member 312 with respect to the weight of the toner cartridge 13 in its brand-new state. In this manner, it is possible to reduce a load received from the first shutter member 311 when the toner cartridge 13 is attached to the inside of the image forming apparatus 1 without increasing the spring pressure of the first shutter spring 316 more than necessary. Accordingly, it is possible to prevent the deflection or creep of the container body 201 of the toner cartridge 13.

Using a static friction coefficient instead of a dynamic friction coefficient in each of the relational expressions described above, it is possible to reliably discharge the toner cartridge 13 to the discharging position at the release of the toner cartridge 13 even if the user stops discharging the toner cartridge 13 in the middle of the discharging.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-168874, filed on Sep. 17, 2019, which is hereby incorporated by reference herein in its entirety.

What is claimed is:

1. An image forming apparatus comprising:

an apparatus body; and a cartridge configured to be attachable to and detachable from the apparatus body in a first direction, the cartridge accommodating developer, wherein the apparatus body includes:

a developer receiving part having a receiving port for receiving the developer from the cartridge, a first shutter movable, in the first direction, between a first open position in which the first shutter opens the receiving port and a first closed position in which the first shutter closes the receiving port, and a first urging member that urges the first shutter in a direction from the first open position to the first closed position, wherein the cartridge includes:

a developer container in which the developer is accommodated, the developer container having a supplying port through which the developer is supplied to the apparatus body, a second shutter movable, in the first direction, between a second open position in which the second shutter opens the supplying port and a second closed position in which the second shutter closes the supplying port, the second shutter having an urged portion and a contacted portion, and a second urging member that urges the second shutter in a direction from the second open position to the second closed position by contacting the urged portion of the second shutter, wherein the developer container of the cartridge has an urging portion urging the first shutter in a direction from the first closed position to the first open position by contacting the first shutter such that the first shutter is in the first open position against an urging force of the first urging member when the cartridge is attached to the apparatus body, wherein a part of the apparatus body, not including the first shutter, has a contacting portion contacting the contacted portion of the second shutter such that the second shutter is in the second open position against an urging force of the second urging member when the cartridge is attached to the apparatus body, and wherein a position of the urging portion of the developer container in a second direction perpendicular to the first direction is the same as a position of the urged portion of the second shutter in the second direction.

2. The image forming apparatus according to claim 1, wherein the urging portion of the developer container is an upstream end surface of the developer container in a detaching direction in which the cartridge is detached from the apparatus body.

3. The image forming apparatus according to claim 1, wherein the cartridge is configured to be moved from a first position to a second position with respect to the apparatus body by an urging force of the first urging member, the first position being a position where the developer is supplied from the cartridge to the apparatus body, the second position being a position downstream of the first position in a detaching direction in which the cartridge is detached from the apparatus body, and wherein the apparatus body further includes a restricting member movable between a restricting position where the cartridge is restricted from being moved from the first position to the second position against the urging force of the first urging member and a non-restricting position where the cartridge is capable of being moved from the first position to the second position.

4. The image forming apparatus according to claim 3, wherein the cartridge further includes a gripping part, and wherein the gripping part is not exposed to outside of the apparatus body when the cartridge is in the first position, and the gripping part is exposed to outside of the apparatus body when the cartridge is in the second position.

5. The image forming apparatus according to claim 1, wherein the first shutter is urged by the first urging member so that a contacting state between the first shutter of the apparatus body and the urging portion of the developer container is maintained until the contacted portion of the second shutter of the cartridge is separated from the contacting portion of the apparatus body while the cartridge is being detached from the apparatus body.

6. The image forming apparatus according to claim 5, wherein the cartridge is configured to be moved from a first position to a second position with respect to the apparatus body by an urging force of the first urging member, wherein the first position is a position where the first shutter is in the first open position, the second shutter is in the second open position, and the supplying port and the receiving port are in communication with each other, and wherein the second position is downstream of the first position in a detaching direction in which the cartridge is detached from the apparatus body, and the first shutter is in the first closed position and the second shutter is in the second closed position when the cartridge is in the second position.

7. The image forming apparatus according to claim 6, wherein the apparatus body further includes a restricting member movable between a restricting position where the cartridge is restricted from being moved from the first position to the second position against the urging force of the first urging member and a non-restricting position where the cartridge is capable of being moved from the first position to the second position.

8. The image forming apparatus according to claim 7, wherein the cartridge further includes a gripping part, and wherein the gripping part is not exposed to outside of the apparatus body when the cartridge is in the first position, and the gripping part is exposed to outside of the apparatus body when the cartridge is in the second position.

9. The image forming apparatus according to claim 1, wherein the supplying port is above the receiving port when the cartridge is attached to the apparatus body.

10. The image forming apparatus according to claim 1, wherein, as the cartridge is being attached to the apparatus body, a time when the first shutter reaches the first open position from the first closed position is earlier than a time when the second shutter reaches the second open position from the second closed position.

11. A cartridge detachably attached to an apparatus body, the apparatus body including a developer receiving part having a receiving port for receiving developer from the cartridge, a first shutter that is movable between a first open position in which the first shutter opens the receiving port and a first closed position in which the first shutter closes the receiving port, and a first urging member that urges the first shutter in a direction from the first open position to the first closed position, the cartridge comprising:

a developer container in which the developer is accommodated, the developer container having a supplying port through which the developer is supplied to the apparatus body, a second shutter movable, in a first direction, between a second open position in which the second shutter opens the supplying port and a second closed position in which the second shutter closes the supplying port, the second shutter having an urged portion and a contacted portion, and a second urging member that urges the second shutter in a direction from the second open position to the second closed position by contacting the urged portion of the second shutter, wherein the developer container of the cartridge has an urging portion configured to urge the first shutter in a direction from the first closed position to the first open position by contacting the first shutter such that the first shutter is in the first open position against an urging force of the first urging member when the cartridge is attached to the apparatus body, wherein the contacted portion of the second shutter is configured to contact a contacting portion of the apparatus body such that the second shutter is in the second open position against an urging force of the second urging member when the cartridge is attached to the apparatus body, and wherein a position of the urging portion of the developer container in a second direction perpendicular to the first direction is the same as a position of the urged portion of the second shutter in the second direction.

12. The cartridge according to claim 11, wherein the urging portion of the developer container is an end surface of the developer container in the first direction.

13. The cartridge according to claim 11, wherein the supplying port opens in the second direction.

14. The cartridge according to claim 11, wherein the contacted portion of the second shutter is closer to the supplying port than the urged portion of the second shutter in the first direction is to the supplying port.

* * * * *